US005545065A

United States Patent [19]

Breivik et al.

[11] Patent Number: 5,545,065

[45] Date of Patent: Aug. 13, 1996

[54] ARRANGEMENT IN A SHIP FOR LOADING/UNLOADING OF A FLOWABLE MEDIUM IN OPEN SEA

[75] Inventors: Kare Breivik, Tau; Arne Smedal, Farvik; Kare Syvertsen, Arenda, all of Norway

[73] Assignee: Den Norske Stats Oljeselskap A.S., Stavanger, Norway

[21] Appl. No.: 244,431

[22] PCT Filed: Mar. 30, 1992

[86] PCT No.: PCT/NO92/00055

§ 371 Date: Aug. 15, 1994

§ 102(e) Date: Aug. 15, 1994

[87] PCT Pub. No.: WO93/11032

PCT Pub. Date: Jun. 10, 1993

[30] Foreign Application Priority Data

Nov. 27, 1991 [NO] Norway ..... 914652

[51] Int. Cl.[6] ..... B63B 22/02

[52] U.S. Cl. ..... 441/5; 114/230

[58] Field of Search ..... 441/3–5; 114/230, 114/74 R, 151, 293

[56] References Cited

U.S. PATENT DOCUMENTS

| | | | |
|---|---|---|---|
| 3,595,278 | 7/1971 | Lilly, Jr. et al. | 114/230 X |
| 4,233,922 | 11/1980 | Conway | 114/74 R |
| 4,490,121 | 12/1984 | Coppens et al. | 441/5 |
| 4,604,961 | 8/1986 | Ortloff et al. | 441/5 X |
| 4,892,495 | 1/1990 | Svensen | 441/5 |
| 5,044,297 | 9/1991 | de Baan | 441/4 X |
| 5,279,245 | 1/1994 | Braud et al. | 114/230 |

FOREIGN PATENT DOCUMENTS

| | | |
|---|---|---|
| 2656274 | 6/1991 | France . |
| 2163403 | 2/1986 | United Kingdom . |

*Primary Examiner*—Sherman Basinger
*Attorney, Agent, or Firm*—Keck, Mahin & Cate

[57] ABSTRACT

An arrangement in a vessel for loading or unloading at sea a flowable medium, especially oil. The vessel is provided with a receiving space for a submarine buoy in the form of a module built on the bow portion of the vessel. The submerged downwardly opening receiving space is connected by a service shaft with the deck of the vessel. The receiving space has a downwardly opening conical shape for mating with a buoy of corresponding outer shape.

18 Claims, 6 Drawing Sheets

ARRANGEMENT IN A SHIP FOR LOADING/UNLOADING OF A FLOWABLE MEDIUM IN OPEN SEA

BACKGROUND OF THE INVENTION

1. Field of the Invention

The invention relates to an arrangement in a vessel for loading or unloading of a flowable medium, especially oil, the vessel being provided with a submerged downwardly open receiving space for receiving and securing a buoy which is anchored to the sea bed and is coupled to at least one transfer line for medium.

2. Background Information

There are previously known various embodiments of loading/unloading systems for the transfer of oil by means of a submerged buoyancy unit or buoy which, during operation, is received and secured in a submerged receiving space on a vessel, especially at the underside thereof. A system comprising a vessel of the above-mentioned type is known from e.g. U.S. Pat. No. 4 604 961 (corresponds to Norwegian patent No. 167 906). This known system is based on a vessel having a through-going deck opening in a central region of the vessel, the lower part of the through opening forming the receiving space for a mooring element in the form of a submerged buoy. In the receiving space there is arranged a rotating body (turret) which is rotatably mounted in the hull of the vessel and is designed for receipt and attachment of the mooring element, the latter to this end being provided with a hydraulically actuated locking mechanism for attachment to the rotating body. Further, the vessel is provided with a derrick for the lowering of a retrieval string having a retrieval connector at its lower end for interconnection with the mooring element, so that this may be pulled up and into the receiving space. The interconnection is obtained in that the mooring element is provided with a conical centering receptacle having a socket arranged at the bottom wherein the retrieval connector may be received and secured, e.g. by means of a bayonet lock. The lower end of the retrieval string preferably is provided with sonar and TV equipment to ensure positioning of the retrieval connector in the centering receptacle.

The known system is encumbered with some drawbacks which will be discussed below.

As mentioned, the vessel of the known system is based on a through-going deck opening, which reduces the strength of the vessel and poses demands for additional reinforcements in the bottom and the deck of the vessel. Experience has also shown that ships having a through-going deck opening are subject to fatigue in the hull. A ship having such a through-going shaft or opening has to be constructed with its definite objective kept in view, and it will be a very expensive solution to carry out modifications of already existing ships to provide them with such an opening.

Since the rotating body is attached to the vessel under water, this requires divers for inspection and minor maintenance. Major maintenance requires docking of the vessel. Because of the fact that the rotating body is mounted to the vessel, there arise large frictional forces which are to be overcome by torques from the mooring element. These torques are relatively large due to the large outer diameter of the rotating body, and this results in correspondingly large loads. Further, it may result in uncontrolled rotation of the system because of large inertial forces, so that it becomes necessary to use a braking system for retaining the rotating body. In case of desired rotation the braking system is then released, and the rotating body is rotated in a controlled manner by means of active drive.

Further, the known system has a small ability to absorb moments caused by the horizontal mooring forces, something which results in a substantial risk for jamming actions in the mounting arrangement.

The hydraulically actuated locking mechanism which is arranged on the mooring element requires divers for connection of the control hydraulics. Diver operations in connection with connection and disconnection render the use of the system as a transport system impossible, when using shuttle tankers. Further, there is a big risk for faulty operation and damages in case of uncontrolled disconnection. In case of breakage of the hydraulic system there is no possibility for the connection of a back-up or auxiliary device.

It is an object of the invention to provide an arrangement in a vessel of the introductorily stated type making it possible to carry out connection and disconnection between vessel and buoy in a quick and simple manner, even in bad weather.

Another object of the invention is to provide an arrangement making possible a very quick disconnection of the buoy if a weather limitation should be exceeded, so that the utilized vessels can be operated as usual ships with respect to service, repair and classification.

A further object is to provide an arrangement giving low total investment and simultaneously the possibility to undertake repairs and replacement of parts on board the vessel, without disconnection of the buoy.

A further object is to provide an arrangement making possible a relatively simple and reasonable rebuilding of existing vessels for adaptation to the utilized buoy loading system.

A still further object of the invention is to provide an arrangement giving a high security in operation and a low risk for contaminating spill.

SUMMARY OF THE INVENTION

The above-mentioned objects are achieved with an arrangement in a vessel of the introductorily stated type, which arrangement is characterized in that the receiving space is arranged at a submerged location at the outer side of the hull of the vessel and has an at least partly downwards essentially conically enlarged shape, for mating with a buoy of a corresponding outer shape, and that a service shaft is arranged in connection with the receiving space, which shaft connects the receiving space with the deck of the vessel.

An especially advantageous embodiment of the invention, wherein the vessel has a bulb-shaped bow portion, is characterized in that the receiving space is formed from a module which is built into the bulb.

By arranging the receiving space at a submerged place at the outer side of the hull of the vessel, one achieves the substantial advantage that no interference is made in the structure of the vessel with a through-going deck opening which will reduce the strength of the vessel. In addition, the tank structure of the vessel will be unaffected, so that the loading capacity is maintained. Further, with the above-mentioned embodiment wherein the receiving space is built into the bow portion of the vessel, the receiving space will be arranged in a region which from before will be constructed for absorbing large loads. By building in a module structure in this portion, it will be relatively simple to carry out reinforcements which do not substantially change the flow resistance of the vessel, but which ensure that the strength of the vessel is kept intact. Since the buoy during transfer of medium also serves as a mooring buoy, the bow portion will be the most favourable place on the vessel, both with respect to absorption of the mooring forces and with respect to the possibility of the vessel to be able to turn under the influence of wind, current, waves and possible ice formations in arctic waters.

As an alternative, the receiving space may also be formed from a module which is connected externally to the outer side of the vessel.

The term "module" is here meant to cover both a prefabricated unit which can be mounted at the vessel side or in a space in the vessel suitable for the purpose, and a device which can be mounted or built at the intended place or in the intended space in the vessel.

The module arrangement according to the invention also gives the possibility for a simple and reasonable rebuilding of existing tankers for adaptation to the buoy loading system. The vessels used may be operated as shuttle tankers which may be classified as usual ships, the arrangement enabling an easy and quick shut-off and disconnection of the buoy if this should be necessary, for example because of necessary repairs or a suddenly occurring gale.

Further advantageous embodiments of the arrangement according to the invention are stated in the remaining dependent claims.

The invention will be further described below with reference to the drawings, wherein

DESCRIPTION OF THE PREFERRED EMBODIMENTS

Figure 1:
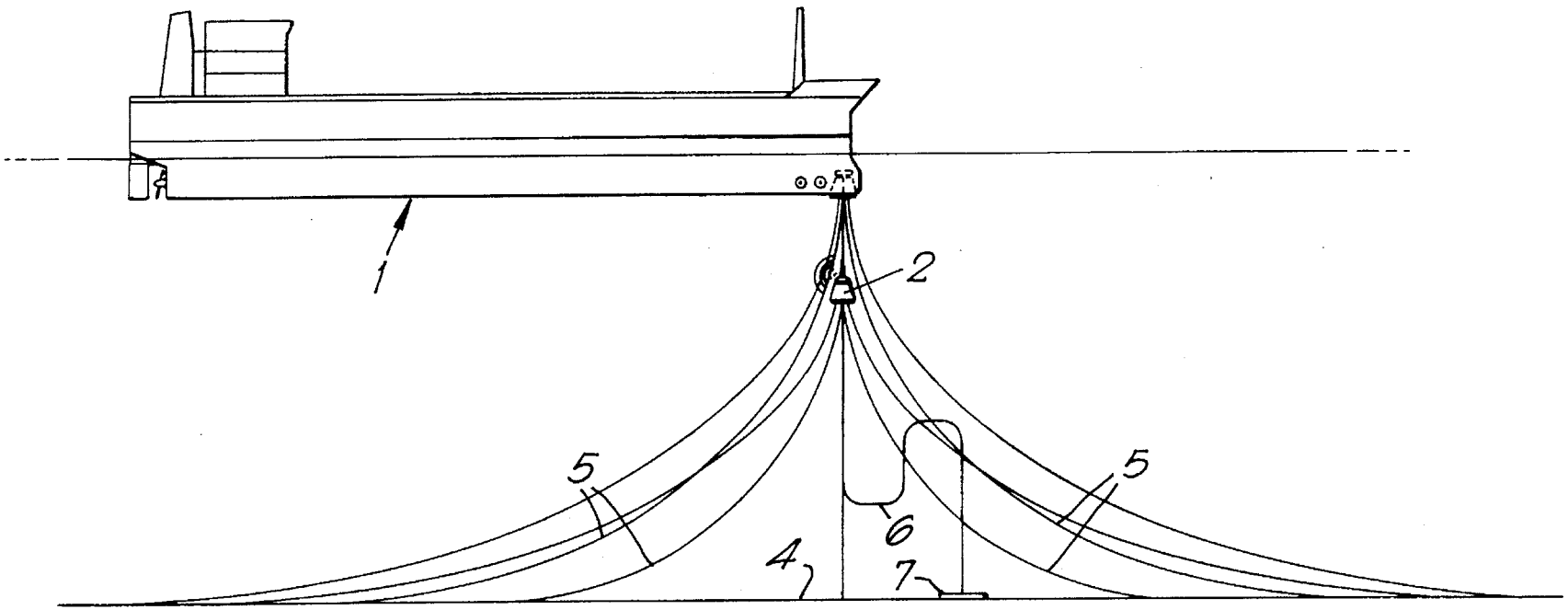
FIG. 1 shows a view of a vessel and an anchored buoy, wherein the buoy is shown in a submerged position of equilibrium as well as in a connected condition.

In the various drawing Figures corresponding members and elements are designated by the same reference numerals.

Before the arrangement according to the invention is described, the utilized buoy loading system will be briefly described with reference to FIG. 1.

Figure 2:
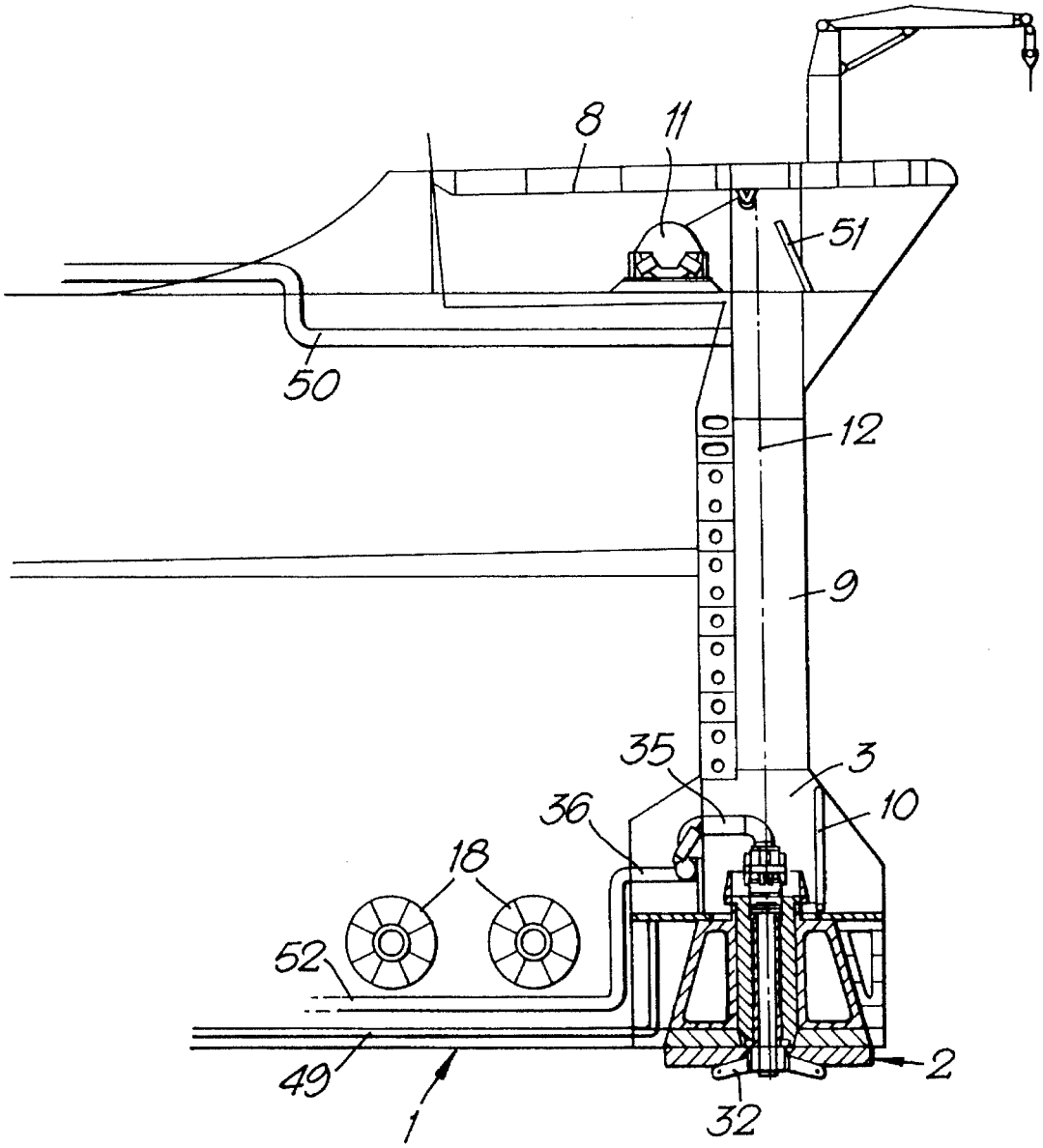
FIGS. 2 and 3 show schematic side views of a part of a vessel which is designed in accordance with the arrangement according to the invention.
Figure 3:
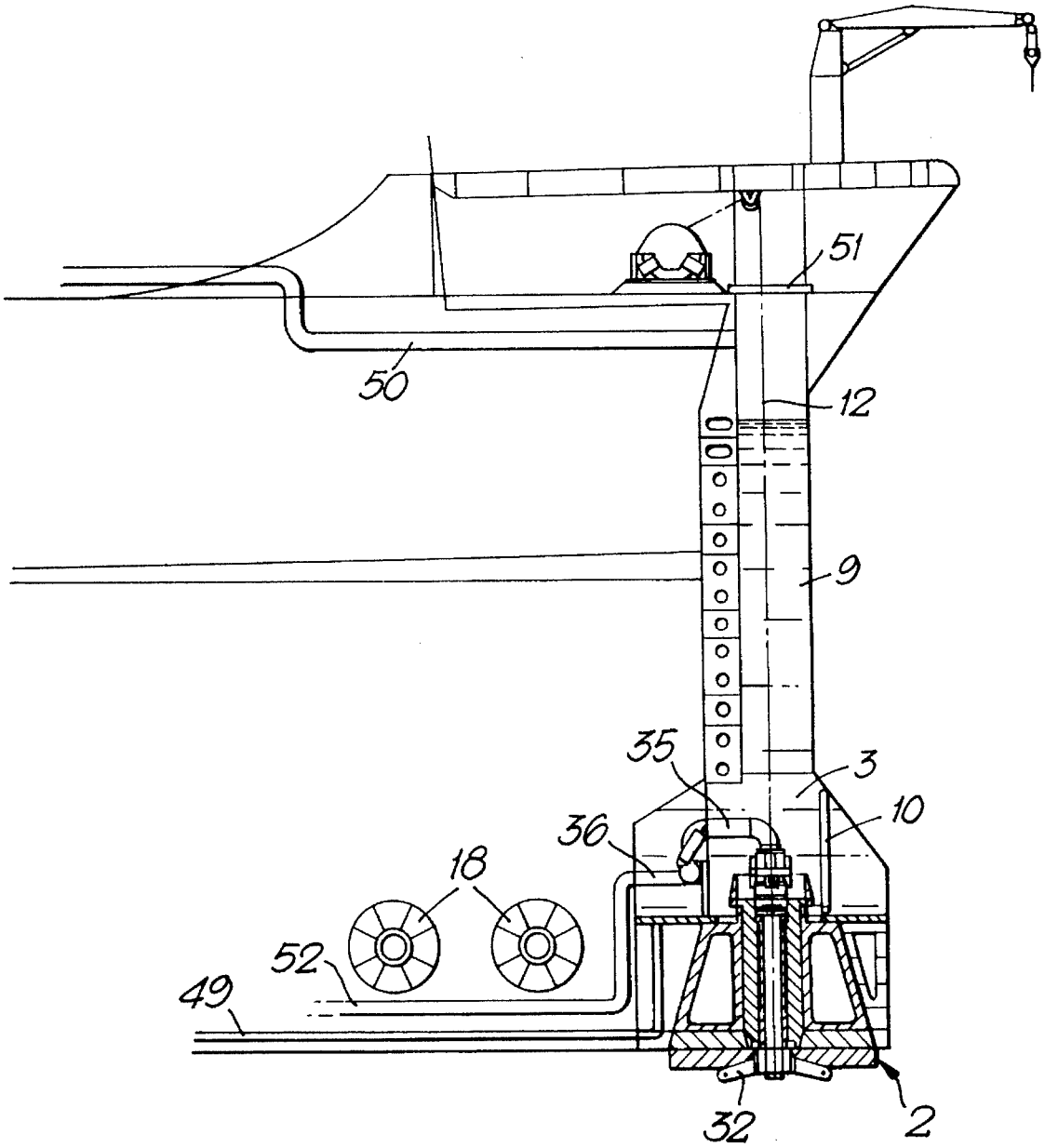

As shown in FIGS. 1–3, the system includes a floating vessel 1 and a buoyancy unit or buoy 2 which is to be connected to the vessel in a receiving space 3 arranged therein and which also will be designated "module". The vessel is a tanker, for example a so-called shuttle tanker, and the buoy is an underwater loading/unloading buoy for the transfer of a flowable medium to or from tanks (not shown) on board the vessel. Normally, the flowable medium will be hydrocarbons (oil or gas), but the expression "flowable medium" here must be construed in a wide sense, since it may also be the question of other flowable materials, also in powder or particle form.

As shown in FIG. 1, the buoy 2 is anchored to the sea bed 4 by means of a suitable number of mooring lines 5 extending as catenary lines between the buoy 2 and suitable anchoring points at the sea bed 4. Each of the mooring lines may consist only of a chain, especially at smaller water depths. Generally, however, it is convenient that each of the mooring lines consists of a chain (partly resting on the sea bed) combined with an upper wire, an elastic hawser or the like, with or without buoyancy buoys (not shown) which may e.g. be placed in the connecting point between the chain and the wire, so that, for the anchoring system, there is obtained a suitable stiffness/characteristic which is adapted to the vessel and water depth in question. Thereby it is achieved that the buoy can be executed in a standard design, independent of the water depth. When the buoy 2 floats in the sea in the lower position in FIG. 1, its buoyancy will be in equilibrium with the forces from the anchoring system, so that the buoy will float at a predetermined desired depth under the water surface, where it will not be damaged or represent any danger to seagoing traffic. The weight of the buoy normally will be in the range of 30–50 tons.

The buoy 2 is coupled to a transfer line 6 in the form of a flexible riser which is shown to extend between the buoy and a station 7 suggested at the sea bed. This station for example may be an installation for the supply or storage of oil, but generally symbolizes a place communicating with the buoy 2 in order to deliver flowable medium to or receive flowable medium from the buoy. In connection with e.g. offshore oil and gas production, the station 7 normally will be located at the sea bed. However, in other applications, it may be located at another place, for example in sheltered waters or on land. In such a case the buoy possibly may be "anchored" only by means of the flexible transfer line. Possibly, more than one transfer line may be connected to the buoy. It is also conceivable that the transfer line, or several transfer lines, is/are connected to a "station" in the form of a corresponding submerged buoy.

The arrangement according to the invention is shown more in detail in FIGS. 2 and 3. In the shown embodiment the receiving space 3 is arranged in the lower part of the bow of the vessel 1. The receiving space 3 is connected with the deck 8 of the vessel through an access or service shaft 9. Further, in the receiving space 3, there is arranged a shutter 10 for shutting off the service shaft 9 and the upper part of the receiving space from the sea when the receiving space is not in use, i.e. when it does not receive a buoy. Among other things, this gives a possibility for inspection of equipment fitted in the shaft and the upper part of the receiving space. Such equipment may include e.g. sensors and TV cameras for monitoring and control purposes, flushing equipment, pumping equipment for drainage purposes, etc.

In the deck area of the vessel there is arranged a hoisting means in the form of e.g. a winch 11 having a suitable line which can be lowered though the shaft 9 and the receiving space 3 and connected with the buoy 2, so that the latter can be hoisted up and moved in place in the receiving space 3. In FIGS. 2 and 3 said line is only suggested with a dash-dotted line 12, the buoy 2 here being shown after having been hoisted up and moved in place in the receiving space 3 by means of the line and the hoisting means. The method and the system for connecting the buoy to the vessel do not constitute a part of the present invention. For a further description of this aspect of the system, reference is made to the simultaneously filed international patent application No. PCT/NO92/00053 which corresponds to U.S. patent application Ser. No. 08/244,441, filed Aug. 8, 1994, and now U.S. Pat. No. 5,456,622.

In the system according to the invention the inner space of the module, i.e. the receiving space, has an at least partly downwardly essentially conically enlarged shape, for mating with a buoyancy unit or buoy having a corresponding outer shape. This also appears from FIGS. 2 and 3 wherein the buoy 2 and the lower part of the receiving space 3 have mating cone shapes.

Figure 4:
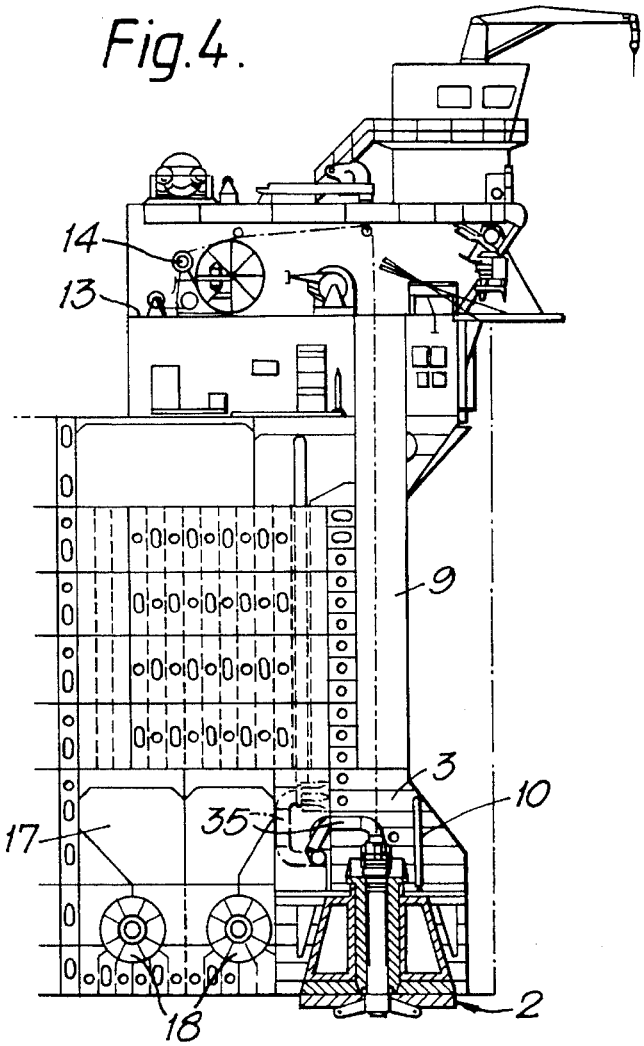
FIG. 4 shows a side view of the forward part of a tanker which has been modified and provided with an arrangement according to the invention.

As will be appreciated by a person skilled in the art, an existing tanker might, without great difficulties and with relatively reasonable costs, be able to be modified or rebuilt in order to be provided with the arrangement according to the invention. An example of an existing ship which has been modified in this manner, is schematically shown in FIG. 4. The arrangement is built into the bow portion of the vessel and comprises essentially the receiving space 3 with associated equipment (to be described later), the access or service shaft 9 connecting the receiving space 3 with an upper deck 13 on the vessel, and the winch means 14 arranged on the deck for lowering and pulling up the lines used in connection with the hoisting of the loading/unloading buoy 2.

Figure 5:
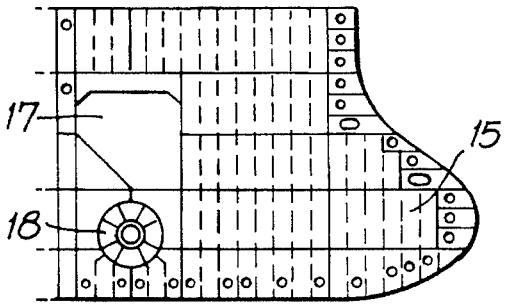
FIG. 5 shows a partial view of the bulb-shaped bow portion of the vessel in FIG. 4 before rebuilding.
Figure 6:
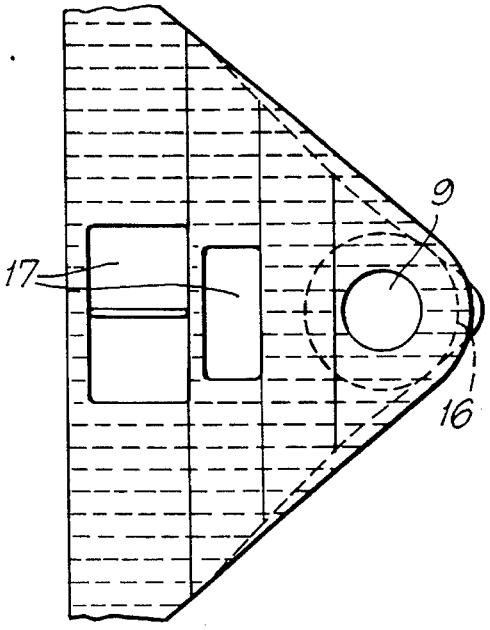
FIG. 6 shows a sectional view, viewed from above, of the vessel in FIG. 4, before (stippled bow contour) and after rebuilding (solid bow contour)

FIG. 5 shows the bulb-shaped bow portion 15 of the ship before the rebuilding, whereas the sectional view in FIG. 6, which shows the bow contour with a stippled line before the rebuilding and a solid line after the rebuilding, illustrates that the bow shape, and therewith the flow resistance of the ship, is only insignificantly changed. The Figure further shows the shaft 9, the contour 15 of the periphery of the buoy 2, and the ship's thruster spaces 17 for receipt of a pair of bow thrusters 18. Such thrusters are also shown in FIGS. 2 and 3.

Figure 7:
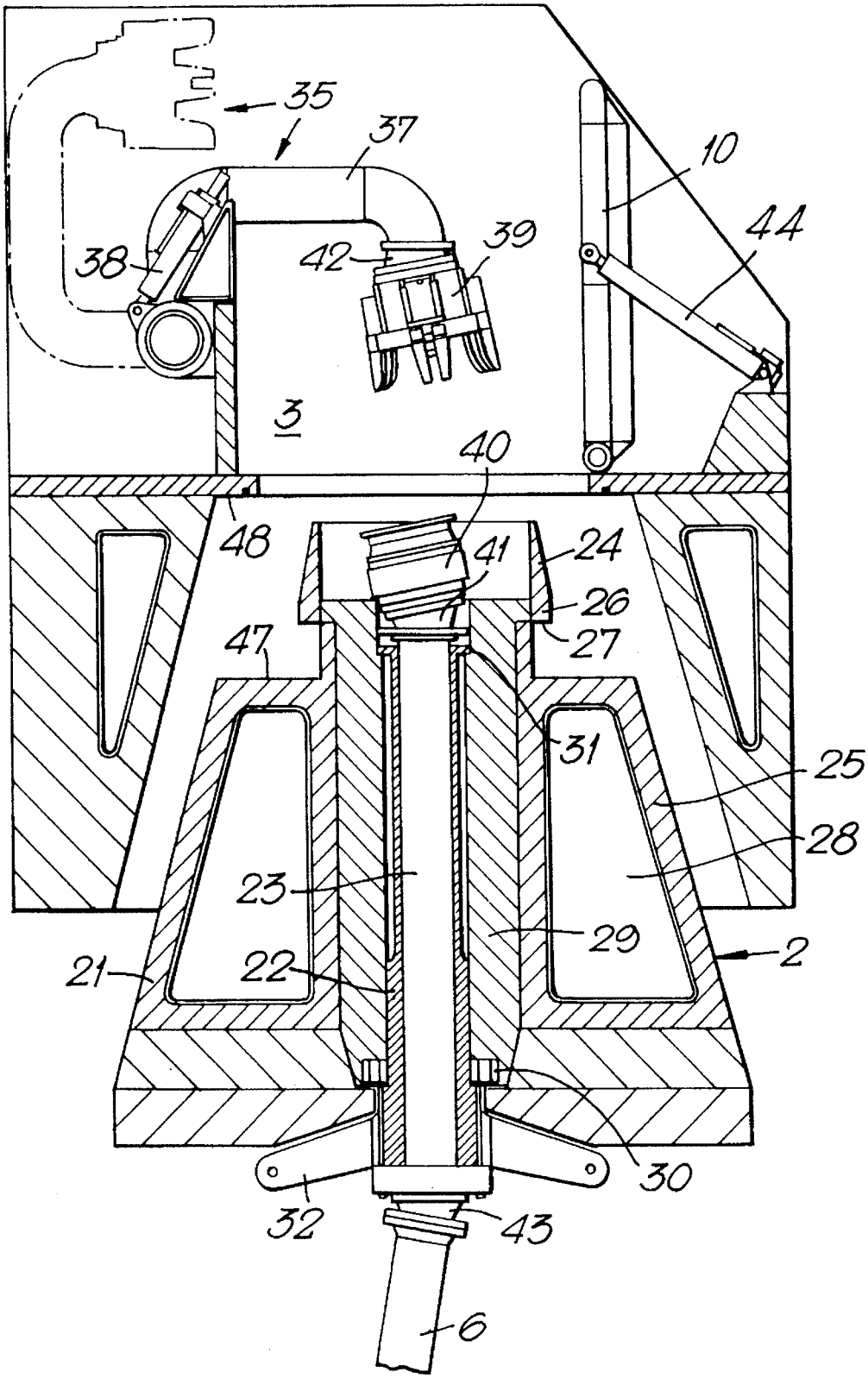
FIG. 7 shows a schematic sectional side view of an embodiment of a module or receiving space in a vessel and a buoy adapted to the receiving space.
Figure 8:
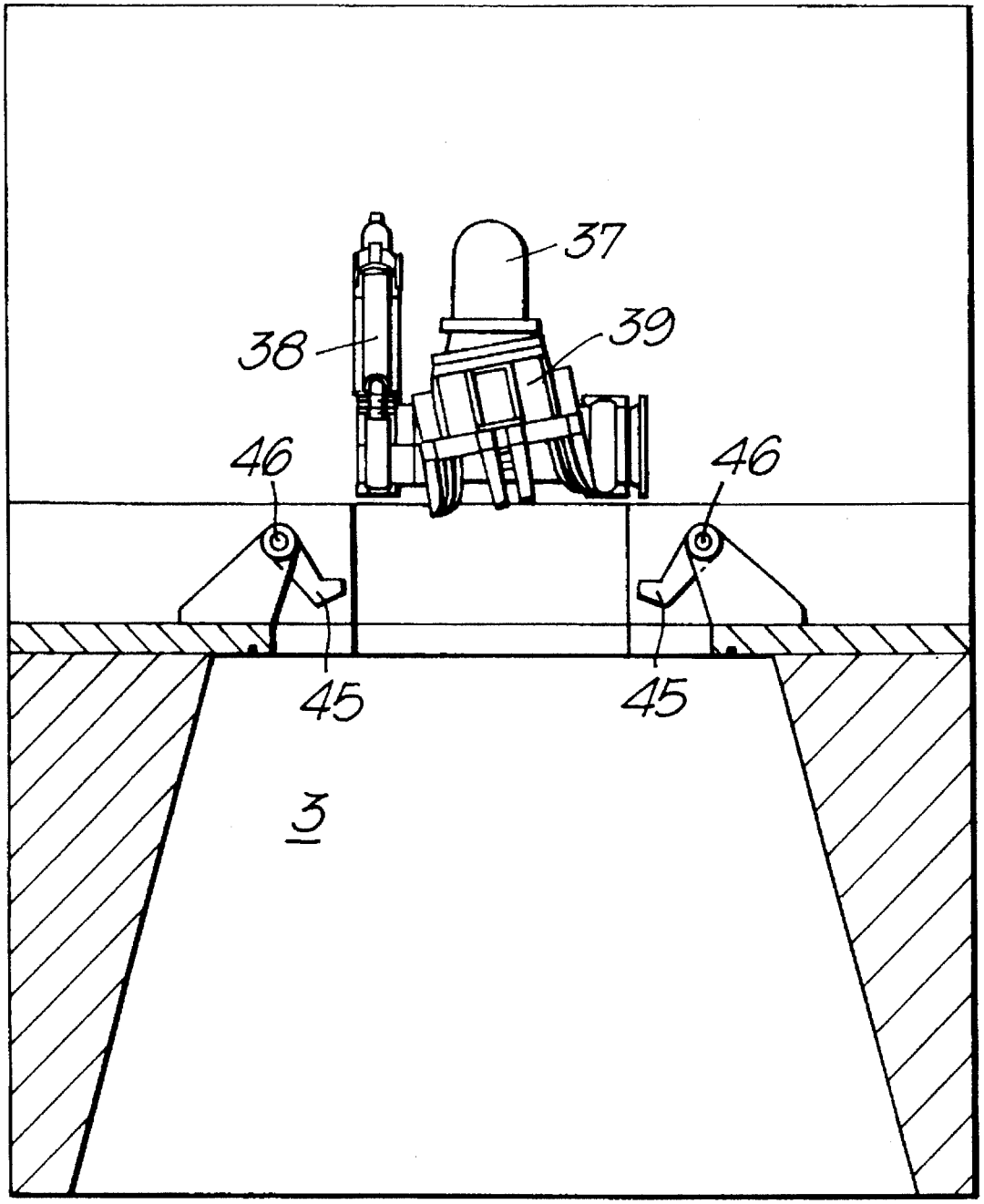
FIG. 8 shows a schematic sectional view of the receiving space in FIG. 7, at right angles to the sectional plane in FIG. 7.

The construction of the buoy 2, and the equipment in the receiving space or module 3, is shown more in detail in FIGS. 7 and 8. As shown in FIG. 7, the buoy comprises an outer buoyancy member 21 and a central member 22 which is rotatably mounted in the outer member and has a through-going passage 23 for medium to be transported via the buoy. When required, the central member may comprise several such passages. As shown in the Figure, the outer buoyancy member 21 comprises an upper and a lower cone member 24 and 25, respectively, and the upper cone member comprises a collar 26 having a downwardly facing annular abutment edge 27 for engagement with locking elements forming part of a locking mechanism (see FIG. 8) arranged in the receiving space 3 for locking of the buoy in the receiving space.

The outer buoyancy member 21 is divided into several water-tight buoyancy chambers 28, and it further comprises a central replaceable bearing support member 29 having a lower radial bearing 30 and an upper axial bearing 31 for the central member 22. When required, the bearing support member 29 can be lifted up from the outer buoyancy member 21 for inspection and possible replacement of parts.

The central member 22, which here has the form of a hollow shaft, is provided with a lower reinforced portion having outwardly projecting arms 32 for attachment of the mooring lines 5 of the buoy 2 (not depicted in FIG. 7).

In the upper part of the receiving space 3 there is arranged a coupling unit 35 which is associated with a tube system 36 (see FIGS. 2 and 3) arranged on the vessel for medium transfer to or from tanks on the vessel. The coupling unit comprises a curved coupling tube 37 which, by means of a hydraulic cylinder 38, is pivotable between a showed position and a connecting position (both positions shown in FIG. 7), one end of the tube being provided with a coupling head 39 for connection to the upper end of the central member 22 of the buoy when the buoy is in place in the receiving space. This connection takes place through a swivel means 40 which, in the illustrated embodiment, is coupled to the central member 22 through a flexible joint 41. Also the coupling head 39 comprises a flexible joint 42. The illustrated embodiment also includes a third flexible joint 43 which is arranged between the lower end of the central member 22 and the transfer line 6 of the buoy. The flexible joints may, for example, be ball joints. The flexible joints 41 and 42 especially are arranged for accommodating fairly large dimensional tolerances when connecting the buoy to different vessels, whereas the flexible joint 43 provides for moment-free transfer of forces from the transfer line 6 to the buoy, and in addition facilitates the positioning of the buoy relative to the receiving space 3, so that the buoy slides easily in place therein.

The aforementioned closing shutter 10 in the upper part of the receiving space 3 is shown to be operated by a hydraulic cylinder 44.

The locking mechanism for releasable locking of the buoy when it is in place in the receiving space 3, is schematically shown in FIG. 8. In the illustrated embodiment the mechanism comprises a pair of locking dogs 45 which are actuated by a hydraulic system and are rotatable about horizontal axes 46 at diametrically opposite sides of the receiving space 3. When activating the locking dogs 45, these will pivot in a vertical plane to engagement with the downwards facing abutment edge 27 of the upper cone member. The locking mechanism preferably is hydraulically or pneumatically activatable and preferably is of the triple redundancy type, which means that, in addition to the main activation, a pair of additional safety mechanisms are ready in case of failure. A typical locking mechanism for example may be adapted for activation by means of hydraulic actuators 53, and the mechanism may comprise several sets of locking elements which are distributed around the periphery of the receiving space, and which are all activated in parallel. A first safety mechanism may consist in that the actuator mechanism is self-locking, for example in that a link arm is moved past a tilting point and thereafter is prevented from further movement. In this manner the locking is made independent of a possible failure of the hydraulic pressure to the actuator. The normal release will take place in that the actuators are activated for release. In case this function should fail, however, there may be arranged a backup system in the form of e.g. hydraulic or pneumatic accumulators. If desired, the locking mechanism may be released manually.

The locking dogs 45 provide for rigid locking of the outer buoyancy member 21 of the buoy to the receiving space 3 (the module), and the vessel 1 then is allowed to turn about the central member 22 which is rotatably mounted in the outer member 21, the swivel means 40 allowing such turning after the coupling tube 37 having been coupled to the buoy.

As appears from FIGS. 2 and 3, the shutter 10 is open when the buoy 2 is introduced into and locked in the receiving space 3. The upper part of the receiving space and a part of the service shaft 9 accordingly will be filled with water when the buoy is introduced in the receiving space, as shown in FIG. 3 (dotted area). When the buoy 2 is locked in place in the receiving space, an upper abutment surface 47 on the outer member 21 of the buoy is brought into sealing abutment against a sealing flange 48 between the upper and lower parts of the receiving space 3 (see FIG. 7), so that the upper part of the receiving space and the service shaft 9 are shut off from the sea. The receiving space and the shaft then can be emptied of water, for example for inspection and maintenance purposes, the receiving space being connected to a drainage conduit 49 for this purpose, as shown in FIGS. 2 and 3. An additional drainage conduit (not shown) may be arranged between the receiving space and a collecting tank on the vessel, to drain possible leakage of transferred medium, such as oil, if such a leakage should occur, for example in connection with the coupling unit 35 in the receiving space.

The shaft 9 is also shown to be connected with a conduit 50 leading to the inert gas and ventilation system of the vessel. Further, the shaft at its upper end is provided with a closing means in the form of a shutter 51. The shaft and the upper part of the receiving space thereby can be filled with inert gas (after removal of the water), as a safety precaution prior to start of transfer of combustible or inflammable medium. In the case shown in FIG. 3 the water has not been removed, so that inert gas is only shown to fill the remaining upper part of the shaft.

As mentioned above, the vessel in the usual manner is provided with bow thrusters 18 for use in positioning of the vessel. The space wherein the thrusters are installed, suitably may be connected to the receiving space 3, so that the receiving space is accessible from the thruster space, and vice versa.

As suggested in FIGS. 2 and 3, the tube system 36 in the receiving space is coupled to a bottom conduit 52 extending along the bottom area of the ship and communicating with the tanks of the vessel. This implies that the transfer line 6 or riser which is coupled to the buoy 2 in the present system is connected directly to the bottom conduit of the vessel, without passing via a pipeline system on the deck of the vessel, in the way it is usual and necessary in conventional systems. This is a substantial advantage in loading or unloading of oil, since one then avoids carrying the oil via a point having a high location in the conduit system (i.e. on the deck), with a pressure drop and consequential gas formation (de-gassing), something which may result in that a not unessential part of the transported oil is lost.

We claim:

1. An arrangement, in a vessel having a hull, for transfer of a flowable medium between said vessel and a transfer line for the medium which is coupled to a buoy anchored to the sea bed, the buoy having a central member, and an outer member rotatably mounted on said central member, the outer member of said buoy having a conical shape, said arrangement comprising:

a module of said vessel in the bow of said vessel providing a submerged downwardly open receiving space, said receiving space having an at least partly conical shape substantially corresponding to the conical shape of the outer member of the buoy, for mating with the buoy, means for releasable locking of the outer member of the buoy in said receiving space, a deck on said vessel, a service shaft having a lower end communicating with said receiving space and an upper end communicating with said deck, hoisting means on said deck for hoisting the buoy into said receiving space, and a sink line extending through said service shaft for connection with said hoisting means and with the buoy, and a first sealing means provided on said module in said receiving space for cooperating with a second sealing means on the buoy, for sealing off said lower end of said service shaft from the surrounding sea when the buoy is secured in said receiving space.

2. The arrangement of claim 1 wherein the vessel has a bulb-shaped bow portion, said module being built into said bulb-shaped bow portion.

3. The arrangement of claim 1 wherein said module is connected externally to the outer side of said hull of said vessel.

4. The arrangement of claim 1 wherein said first sealing means is a downwardly facing sealing flange in said receiving space and said second sealing means is an abutment sealing surface on the buoy, said sealing flange and the abutment sealing surface forming a seal when the buoy is received in said receiving space.

5. The arrangement of claim 1 further comprising a thruster space in said vessel and thrusters in said thruster space, said receiving space being accessible from said thruster space and vice versa.

6. The arrangement of claim 1 wherein said locking means comprises at least a pair of hydraulically actuated locking dogs and means mounting said dogs for rotation about horizontal axes in said receiving space between locking and release positions.

7. The arrangement of claim 1 wherein the central member of the buoy has at least one through-going passage for said medium.

8. The arrangement of claim 7 further comprising a tube system for said medium, a coupling unit in said receiving space connected to said tube system, and a coupling head and flexible joint included in said coupling unit for connection to said central member of said buoy.

9. The arrangement of claim 8 wherein said coupling unit comprises a coupling tube pivotable between a stowed position and a connecting position, one end of said coupling tube carrying said coupling head.

10. The arrangement of claim 8 further comprising a bottom conduit leading to one or more tanks in said vessel, said tube system being coupled directly to said bottom conduit.

11. The arrangement of claim 1 further comprising a shutter in said receiving space at the lower end of said shaft for shutting-off said shaft from the sea when said receiving space is not in use.

12. The arrangement of claim 11 further comprising a closing means at the upper end of said shaft.

13. The arrangement of claim 12 further comprising an inert gas and ventilation system on said vessel and connected to said service shaft.

14. The arrangement of claim 1 further comprising at least one drainage conduit for drainage of liquid from said receiving space and said shaft.

15. An arrangement for transfer of a flowable medium between a vessel and a transfer line for the medium, the arrangement comprising:

a module of said vessel providing a submerged downwardly open receiving space, a buoy anchored to the sea bed and coupled to said transfer line, said receiving space having an at least partly conical shape and said buoy having a substantially corresponding outer shape for mating with said receiving space shape, a deck on said vessel, a service shaft having a lower end communicating with said receiving space and an upper end communicating with said deck, and a shutter in said receiving space at said lower end of said service shaft for shutting-off said service shaft from the sea when said receiving space is not in use.

16. The arrangement of claim 15 further comprising a closing means at said upper end of said shaft.

17. The arrangement of claim 16 further comprising an inert gas and ventilation system on said vessel and connected to said service shaft.

18. An arrangement for transfer of a flowable medium between a vessel and a transfer line for the medium, the system comprising:

a module of said vessel providing a submerged downwardly open receiving space, a buoy anchored to the sea bed and coupled to said transfer line, said receiving space having an at least partly conical shape and said buoy having a substantially corresponding outer shape for mating with said receiving space shape, a deck on said vessel, and a service shaft communicating said receiving space with said deck, and at least one drainage conduit for drainage of liquid from said receiving space and said shaft.

* * * * *